US007336471B2

(12) United States Patent
Suehira et al.

(10) Patent No.: US 7,336,471 B2
(45) Date of Patent: Feb. 26, 2008

(54) CHARGE ELIMINATING MECHANISM FOR STAGE AND TESTING APPARATUS

(75) Inventors: Nobuhito Suehira, Nirasaki (JP); Yoshimune Misawa, Nirasaki (JP)

(73) Assignee: Tokyo Electron Limited, Tokyo (JP)

( * ) Notice: Subject to any disclaimer, the term of this patent is extended or adjusted under 35 U.S.C. 154(b) by 24 days.

(21) Appl. No.: 10/790,038

(22) Filed: Mar. 2, 2004

(65) Prior Publication Data

US 2004/0178788 A1 Sep. 16, 2004

Related U.S. Application Data

(63) Continuation of application No. PCT/JP03/00539, filed on Jan. 22, 2003.

(30) Foreign Application Priority Data

Jan. 23, 2002 (JP) ..... 2002-014559

(51) Int. Cl.
*H05F 3/00* (2006.01)

(52) U.S. Cl. ..... 361/220; 361/212; 361/234

(58) Field of Classification Search ..... 361/212, 361/220

See application file for complete search history.

(56) References Cited

U.S. PATENT DOCUMENTS

| | | | | |
|---|---|---|---|---|
| 5,280,979 | A * | 1/1994 | Poli et al. | 294/64.1 |
| 5,880,924 | A * | 3/1999 | Kumar et al. | 361/234 |
| 6,778,258 | B2 * | 8/2004 | del Puerto et al. | 355/72 |
| 6,878,233 | B2 * | 4/2005 | Hirose | 156/345.28 |

FOREIGN PATENT DOCUMENTS

| | | |
|---|---|---|
| JP | 63-138745 | 6/1988 |
| JP | 4-57625 | 2/1992 |
| JP | 5-226438 | 9/1993 |
| JP | 6-9098 | 2/1994 |

* cited by examiner

*Primary Examiner*—Michael Sherry
*Assistant Examiner*—Lucy Thomas
(74) *Attorney, Agent, or Firm*—Oblon, Spivak, McClelland, Maier & Neustadt, P.C.

(57) ABSTRACT

A charge eliminating mechanism of the invention includes a mechanical switching mechanism (e.g., a POGO pin), and a wiring line so connected as to be able to be electrically connected to the POGO pin. The wiring line can include a resistor. A block holds the POGO pin. The POGO pin comes into contact with a charge eliminating plate provided on a stage, so that the static electricity of the stage is discharged to ground.

10 Claims, 2 Drawing Sheets

CHARGE ELIMINATING MECHANISM FOR STAGE AND TESTING APPARATUS

CROSS-REFERENCE TO RELATED APPLICATIONS

This is a Continuation Application of PCT Application No. PCT/JP03/00539, filed Jan. 22, 2003, which was not published under PCT Article 21(2) in English.

This application is based upon and claims the benefit of priority from the prior Japanese Patent Application No. 2002-014559, filed Jan. 23, 2002, the entire contents of which are incorporated herein by reference.

BACKGROUND OF THE INVENTION

1. Field of the Invention

The present invention relates to a charge eliminating mechanism for a stage, and a testing apparatus. More specifically, the present invention relates to a charge eliminating mechanism for a stage, which prevents any damage to a work-to-be-processed when testing the electrical characteristics of the work-to-be-processed, and a testing apparatus.

2. Description of the Related Art

A process for processing a work-to-be-processed (e.g., a semiconductor manufacturing process) has a step of testing a plurality of semiconductor elements (to be referred to as "devices" hereinafter) formed on a wafer-like substrate. As shown in, e.g., FIGS. 3A and 3B, a testing apparatus which performs this step can have a loader chamber 1 to transport wafers W stored in a cassette C one by one, and a prober chamber 2 adjacent to the loader chamber 1 to test the electrical characteristics of the devices.

As shown in FIGS. 3A and 3B, the loader chamber 1 can have a wafer transporting mechanism 3 which transports the wafers W one by one, and a rough positioning mechanism (to be referred to as a "sub chuck" hereinafter) 4 which aligns the direction of the wafer W transported by the wafer transporting mechanism 3.

The prober chamber 2 can have a stage 5 which moves in three-axis directions (X, Y, and Z directions) with the wafer W placed thereon and rotates in the forward and reverse directions along a θ direction, a probe card 6 arranged above the stage 5, and a positioning mechanism (to be referred to as an "alignment mechanism" hereinafter) 7 which aligns probes 6A of the probe card 6 and the wafer W on the stage 5 with each other.

The probe card 6 is fixed to a head plate 8 of the prober chamber 2. A test head T is arranged on the head plate 8. The test head T electrically connects the probe card 6 to an external tester.

When testing the electrical characteristics of devices formed on the wafer W, the wafer transporting mechanism 3 picks up the wafer W from the cassette C and places it on the stage 5 in the prober chamber 2. While the wafer transporting mechanism 3 transports the wafer W, the wafer W is aligned in a given direction on the sub chuck 4. In the prober chamber 2, the stage 5 is moved in the X, Y, and θ directions, so that the wafer W and probes 6A are aligned through the alignment mechanism 7. The stage 5 moves in the X and Y directions to position the first device immediately under the probes 6A. After that, the stage 5 moves upward in the Z direction, so that the device and the probes 6A are brought into electrical contact with each other. After the stage further overdrives, the electrical characteristics of the device are tested. After the test, the stage 5 moves downward, and the stage 5 repeats index feeding of the wafer W, so that the electrical characteristics of the plurality of devices formed on the wafer W are tested. After these devices are tested, the wafer transporting mechanism 3 returns the wafer W to the original position in the cassette C. The above operation is repeated to test the electrical characteristics of the devices formed on the next wafer W.

BRIEF SUMMARY OF THE INVENTION

The stage 5, however, is electrostatically charged. This static electricity is transferred to the wafer W as well. Hence, when the device and the probes 6A are to be brought into contact with each other for the purpose of testing the electrical characteristics of the work-to-be-processed formed on the wafer W, arc is generated by discharge between the device and probes 6A. The arc may damage the device. As the devices become very highly integrated and thin, this phenomenon is becoming obvious.

The present invention has been made to solve at least one of the above problems.

It is an object of the present invention according to one aspect to provide a charge eliminating mechanism for a stage, which can prevent any damage to a work-to-be-processed such as a device.

It is another object of the present invention according to another aspect to provide a testing apparatus having a charge eliminating mechanism for a stage.

According to one aspect of the present invention, there is provided a charge eliminating mechanism for a stage to place a work-to-be-processed thereon. The charge eliminating mechanism comprises:

a grounded wiring line having a first end and a second end, the second end being grounded; and a mechanical switching mechanism arranged between the stage and the first end of the wiring line.

According to another aspect of the present invention, there is provided a testing apparatus comprising a charge eliminating mechanism which includes:

a grounded wiring line having a first end and a second end, the second end being grounded; and a mechanical switching mechanism arranged between the stage and the first end of the wiring line.

The charge eliminating mechanism provided according to one aspect and the testing apparatus provided according to another aspect preferably comprise at least one of the following (1) to (6). Furthermore, these inventions preferably comprise a combination of at least any two, three, or more of the following (1) to (6).

(1) The work-to-be-processed which is a work to be tested.

(2) The wiring line including a resistor between the first and second ends.

(3) The mechanical switching mechanism comprising:

a contact terminal including a contact terminal main body, a third end, and a fourth end, the fourth end being electrically connected to ground or the first end of the wiring line, and a physical contact state between the third end and the stage being turned on/off, wherein when the third end is in contact with the stage, the stage is grounded through the third end of the contact terminal, the contact terminal main body, the fourth end, the first end of the wiring line, a resistor, and a second end of the resistor.

(4) An elastic contact mechanism provided on at least one of the contact terminal and the stage to cause the third end of the contact terminal and the stage to come into elastic contact with each other.

(5) A stage rotatable in forward and reverse directions, and a charge eliminating plate with spring properties formed on a side surface of the stage.

(6) A POGO pin serving as an elastic contact mechanism provided on the contact.

BRIEF DESCRIPTION OF THE SEVERAL VIEWS OF THE DRAWING

FIGS. 3A and 3B are views showing an example of another inspecting apparatus, in which FIG. 3A is a side view showing the interior of the testing apparatus, and FIG. 3B is a plan view of FIG. 3A.

DETAILED DESCRIPTION OF THE INVENTION

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

The present invention relates to a charge eliminating mechanism for a stage to place a wafer-like substrate (e.g., a work to be tested) on it. The charge eliminating mechanism can be employed in a testing apparatus which tests the electrical characteristics of a plurality of devices formed on the wafer. The charge eliminating mechanism of the present invention, however, can also be employed in a stage to place various types of work-to-be-processed such as a liquid crystal substrate on it. In this description, to explain the present invention more practically, an embodiment of the present invention will be described with reference to a case wherein the charge eliminating mechanism is employed in a testing apparatus which tests the electrical characteristics of a plurality of devices formed on a wafer.

Figure 1:
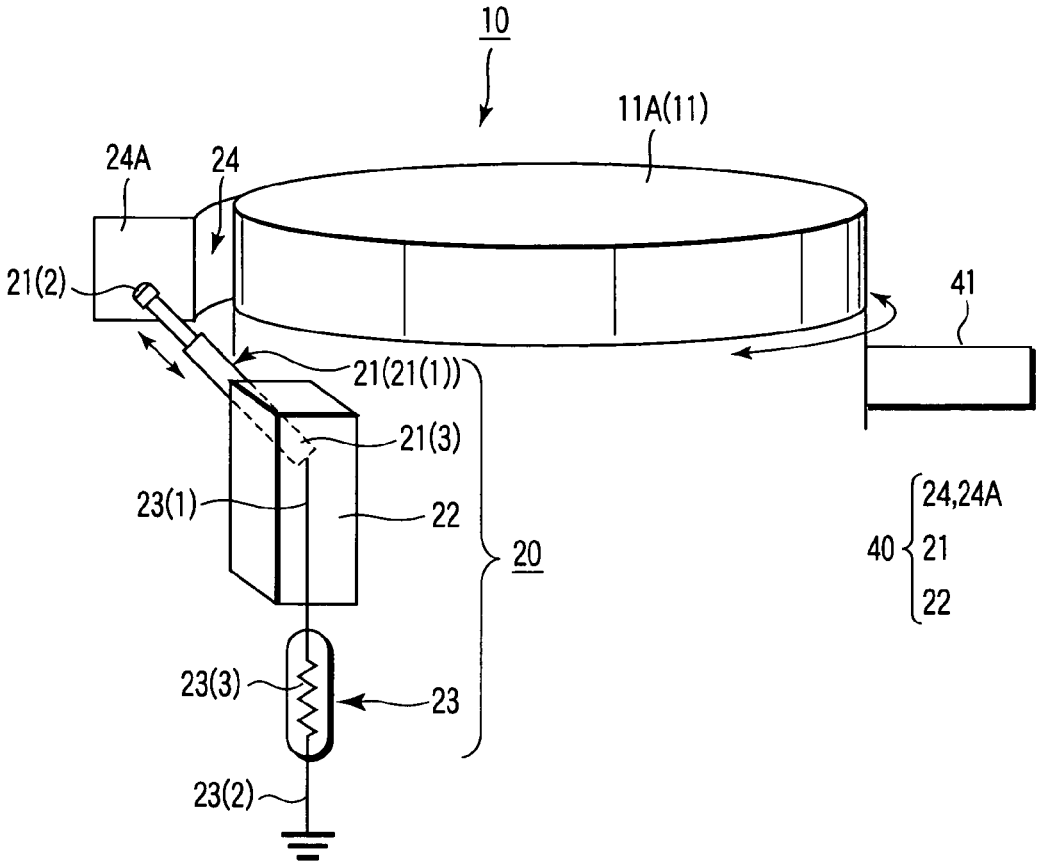
FIG. 1 is a conceptual view showing a charge eliminating mechanism according to an embodiment of the present invention.

The present invention will be described hereinafter with reference to the embodiment shown in FIGS. 1 and 2. As shown in FIG. 1, a testing apparatus 10 according to this embodiment is formed in the same manner as a conventional testing apparatus, except for a charge eliminating mechanism 20 of this embodiment. Hence, the charge eliminating mechanism 20 of the testing apparatus shown in FIG. 1 will be described. A stage 11 can have a chuck top 11A where a wafer-like substrate (to be referred to as a "wafer" hereinafter) is placed. The stage can be rotated in the forward and reverse directions by a rotational drive mechanism 41. The stage 11 (chuck top 11A) and the wafer placed on the chuck top 11A are statically charged. When testing the work-to-be-processed (to be referred to as the "device") formed on the wafer, the static electricity may damage the device.

According to this embodiment, when exchanging the wafers, the static electricity of the stage 11 (chuck top) is eliminated by the charge eliminating mechanism 20 of this embodiment. As shown in FIG. 1, the charge eliminating mechanism 20 according to this embodiment has a grounded wiring line 23 and a mechanical switching mechanism (to be referred to as a "switch" hereinafter) 40 arranged between the stage and wiring line.

The wiring line 23 has a first end 23 (1) and second end 23 (2). The second end is grounded. A resistor 23 (3) can be arranged between the first end and the second end. This resistor can limit the current value discharged from the stage 11 to ground.

The switch 40 mechanically turns on/off the connection state between the stage 11 and the wiring line. An embodiment of the switch 40 will be described with reference to FIG. 1. The switch 40 can employ a contact 21 fixed to a block 22. The contact 21 electrically comes into contact with the stage by an elastic contact mechanism 21 (1).

The contact 21 can have a third end 21 (2) and fourth end 21 (3). The elastic contact mechanism 21 (1) preferably extends and contracts in the directions of arrows shown in FIG. 1. When the elastic contact mechanism 21 (1) is extended, the third end 21 (2) is in contact with the stage 11. In this contact state, the stage 11 is connected to ground through the third end 21 (2) of the contact 21, the contact main body 21 (1), the fourth end 21 (3), the first end 23 (1) of the wiring line 23, the resistor 23 (3), and the second end 23 (2).

As the elastic contact mechanism 21 (1), a POGO pin is preferably employed.

According to another embodiment of the switching mechanism, in addition to the contact 21 and wiring line 23 described above, a charge eliminating plate 24 attached to the stage 11 is preferably provided.

The charge eliminating plate 24 is electrically connected to the chuck top 11A of the stage 11. An end 24A of the charge eliminating plate 24 projects outward from the chuck top 11A. Preferably, the charge eliminating plate 24 is made of a conductive metal and has spring properties.

The contact 21 is separate from the charge eliminating plate 24 when it does not eliminate static electricity from the chuck top 11A. Consequently, the switch 40 is OFF.

The block 22 holds the contact 21 (to be referred to as the "POGO pin" hereinafter).

The operation of the apparatus shown in FIG. 1 will be described.

Figure 3A:
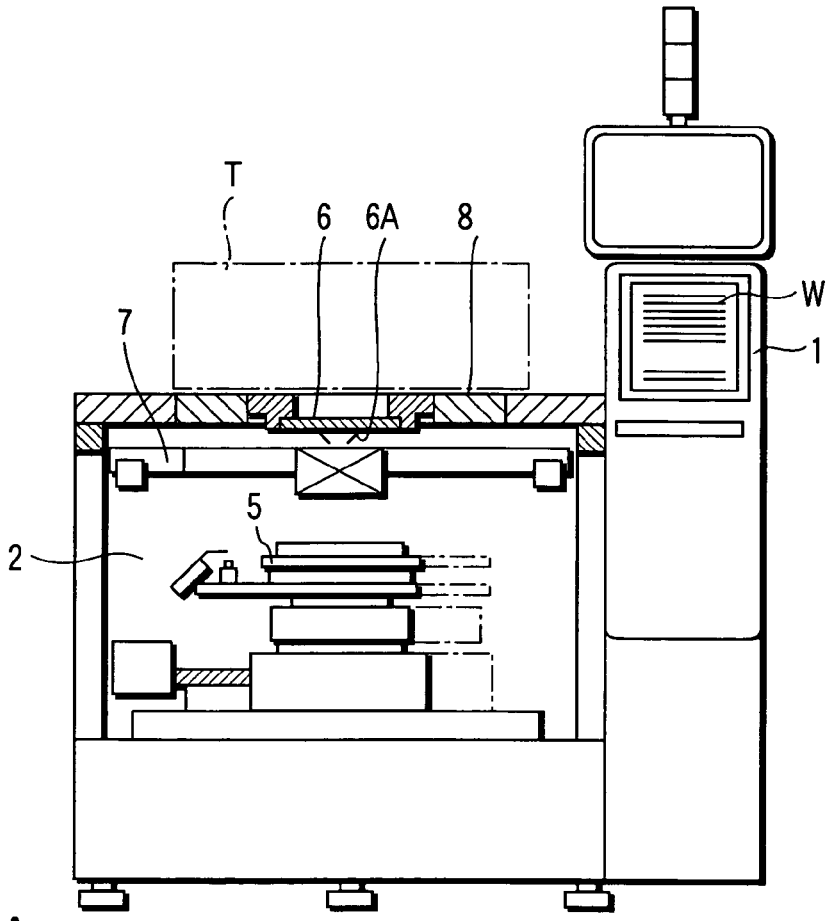
Figure 3B:
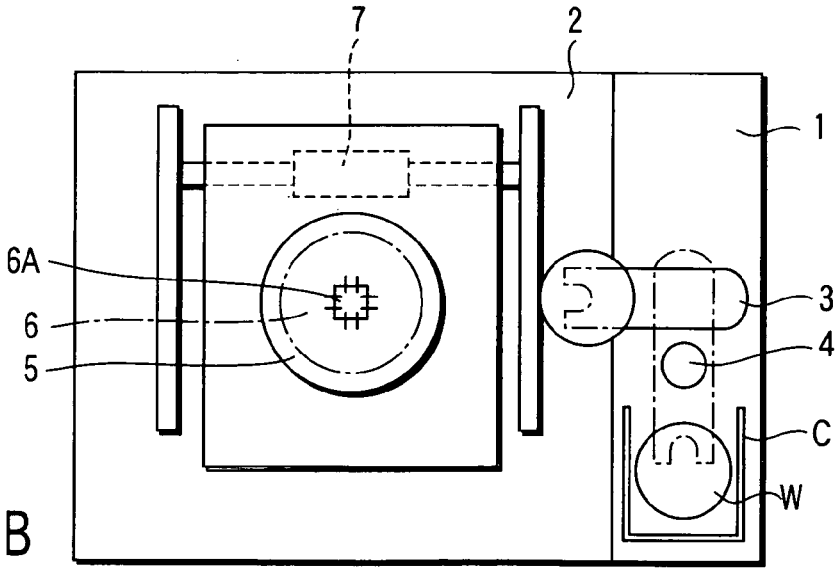

The electrical characteristics of all devices formed on the wafer are tested in the same manner as in the conventional case, and the wafer on the chuck top 11A is unloaded from the prober chamber with a wafer transporting mechanism 3 (FIG. 3B). Before receiving the next wafer, for example, the stage 11 rotates counterclockwise, and is set in the state shown in FIG. 1.

In this state, the end 24A of the charge eliminating plate 24 and the third end 21 (2) of the POGO pin 21 elastically come into contact with each other. More specifically, the end 24A of the charge eliminating plate 24 presses the third end 21 (2). Hence, the end 24A of the charge eliminating plate 24 partly separates from the outer surface of the stage 11, and the third end 21 (2) of the POGO pin 21 contracts. In this state, the switch 21 is ON. The chuck top 11A and POGO pin 21 are electrically connected to each other through the charge eliminating plate 24.

In this state, the static electricity that charges the chuck top 11A flows to ground through the charge eliminating plate 24A, POGO pin 21, and resistor 23 (3), and consequently the static electricity is eliminated.

Subsequently, the stage 11 rotates in the reverse direction so that the POGO pin 21 separates from the end 24A of the charge eliminating plate 24. Consequently, the switch 21 is turned off, and the chuck top 11A is electrically isolated from ground.

After the chuck top 11A is statically discharged, the wafer transporting mechanism 3 places the next wafer onto the chuck top 11A. The alignment mechanism aligns the wafer on the stage 11 and the probes. When the electrical characteristics of the respective devices formed on the wafer are to be tested, the wafer is not electrically charged because static electricity has been eliminated from the stage 11 (chuck top 11A). Therefore, even if any probe comes into contact with a device on the wafer, no arc is generated by electric discharge, so that the device is prevented from being damaged, thus preventing a decrease in yield of the devices. Since the POGO pin 21 of the charge eliminating mechanism 20 mechanically separates the chuck top 11A and ground, the current does not leak from the chuck top 11A. As a result, stable, reliable testing can be performed.

As described above, according to this embodiment, the charge eliminating mechanism 20 having a mechanical switching mechanism can eliminate the static electricity built on the chuck top 11A. In testing, arc caused by electric discharge between the wafer and probes is prevented, so that any damage to the wafer can be prevented.

According to this embodiment, since the resistor 23 (3) is formed between the POGO pin 21 and ground, abrupt discharge of the static electricity can be avoided.

According to this embodiment, since the POGO pin 21 having a small pressing force is used as the switch, the mechanical load on the chuck top 11A can be reduced.

Figure 2:
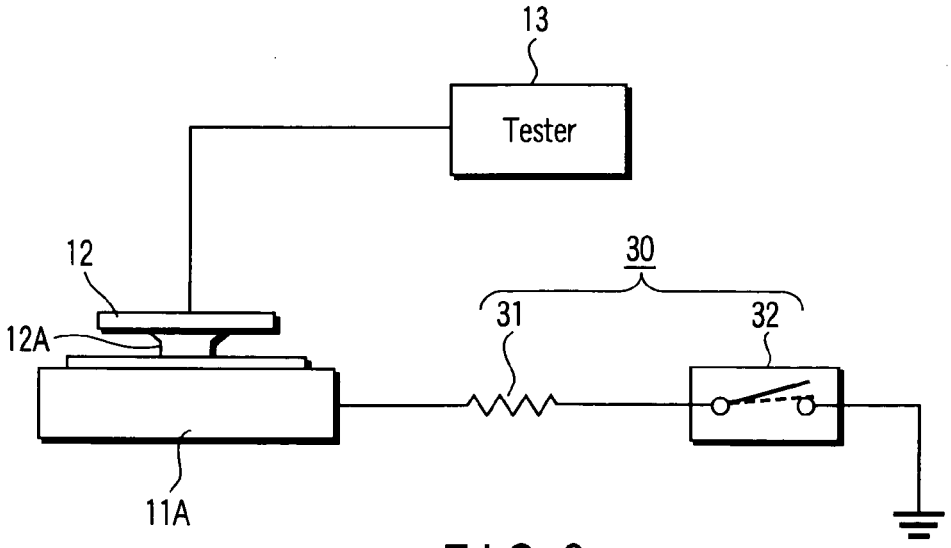
FIG. 2 is a conceptual view showing a conventional charge eliminating mechanism.

FIG. 2 is a conceptual view showing another charge eliminating mechanism. This charge eliminating mechanism 30 has a resistor 31 connected to a chuck top 11A, and a relay 32 grounded and connected to the resistor 31. When exchanging wafers W, the relay 32 is electronically turned on, as indicated by a broken line, so that the static electricity of the chuck top 11A is eliminated. As the charge eliminating mechanism 30 uses the relay 32, sometimes a current on the order of picoampere leaks. For this reason, when measuring a small current on the order of picoampere during testing, the stability of the test may be interfered with. In this charge eliminating mechanism, as shown in FIG. 2, in a testing state wherein probes 12A of a probe card 12 are in contact with the wafer W, the resistor 31 is connected to the chuck top 11A. As the resistor 31 serves as an antenna, the resistor picks up noise. The noise may undesirably interfere with the stability of the test performed by a tester 13.

Since the charge eliminating mechanism requires a power supply for driving the relay 32, it has a somewhat complicated structure. Although the charge eliminating mechanism 30 may have some problems in this manner, as long as a small current is not measured, testing can be performed without any trouble such as damage to the wafer.

The present invention is not limited to the above embodiments, but the respective constituent elements may be appropriately changed in design when necessary.

For example, the charge eliminating mechanism 20 of the above embodiment has the resistor 23 (3) between the POGO pin 21 and ground. The static electricity of the chuck top 11A can be eliminated without the resistor 23 (3).

Alternatively, no charge eliminating plate 24 need be provided, and the chuck top 11A may be moved in the X and Y directions, so that the chuck top 11A can be brought into direct contact with the POGO pin 21.

According to the embodiments of the present invention, a charge eliminating mechanism that can prevent any damage to a work-to-be-processed (semiconductor element), and a testing apparatus can be provided.

What is claimed is:

1. A charge eliminating mechanism for a stage for a work-to-be-processed, comprising:

a grounded wiring line having a first end and a second end, the second end being grounded; and a mechanical switching mechanism arranged between the stage and the first end of the wiring line, wherein the mechanical switching mechanism of the charge eliminating mechanism comprises:

a contact terminal including a contact terminal main body, a third end, and a fourth end, the fourth end being electrically connected to the first end of the wiring line, and a contact state between the third end and the stage being physically turning on/off, and when the third end is in contact with the stage, the stage is grounded through the third end of the contact terminal, the contact terminal main body, the fourth end, the first end of the wiring line, a resistor, and the second end of the wiring line, and wherein at least one of the contact terminal and the stage includes an elastic contact mechanism to cause the third end of the contact terminal and the stage to come into elastic contact with each other by moving the stage in X and Y directions.

2. A charge eliminating mechanism according to claim 1, wherein the stage is rotatable in forward and reverse directions, and the elastic contact mechanism provided on the stage is a charge eliminating plate with spring properties formed on a side surface of the stage.

3. A charge eliminating mechanism according to claim 1, wherein the elastic contact mechanism provided on the contact is a POGO pin.

4. A charge eliminating mechanism according to claim 1, wherein the work-to-be-processed is a work to be tested, and the wiring line includes a resistor between the first and second ends.

5. A charge eliminating mechanism according to claim 1, wherein the third end is configured to contact an outer perimeter side surface of the stage in order to ground the stage.

6. A testing apparatus comprising a charge eliminating mechanism for a stage for a work-to-be-processed, which tests electrical characteristics of a work-to-be-processed, the charge eliminating mechanism comprising:

a grounded wiring line having a first end and a second end, the second end being grounded; and a mechanical switching mechanism arranged between the stage and the first end of the wiring line, wherein the mechanical switching mechanism comprises:

a contact terminal having a contact terminal main body, a third end, and a fourth end, the fourth end being electrically connected to the first end of the wiring line, and a contact state of the third end with respect to the stage being physically turned on/off, and when the third end is in contact with the stage, the stage is grounded through the third end of the contact terminal, the contact terminal main body, the fourth end, the first end of the wiring line, a resistor, and the second end of the wiring line, and wherein at least one of the contact terminal and the stage includes an elastic contact mechanism to cause the third end of the contact terminal and the stage to come into elastic contact with each other by moving the stage in X and Y directions.

7. A testing apparatus according to claim 6, wherein the stage is rotatable in forward and reverse directions, and the elastic contact mechanism provided on the stage is a charge eliminating plate with spring properties formed on a side surface of the stage.

8. A testing apparatus according to claim 6, wherein the elastic contact mechanism provided on the contact is a POGO pin.

9. A testing apparatus according to claim 6, wherein the wiring line includes a resistor between the first and second ends.

10. A testing apparatus according to claim 6, wherein the third end is configured to contact an outer perimeter side surface of the stage in order to ground the stage.

* * * * *